United States Patent [19]

Kirkpatrick

[11] Patent Number: 4,606,541

[45] Date of Patent: Aug. 19, 1986

[54] DOOR MOUNTED EXERCISING DEVICE

[76] Inventor: Thomas L. Kirkpatrick, 3509 Quincy Ave., Simi Valley, Calif. 93063

[21] Appl. No.: 739,527

[22] Filed: May 31, 1985

[51] Int. Cl.[4] ..... A63B 21/04

[52] U.S. Cl. ..... 272/136; 272/143; 272/900; 403/349

[58] Field of Search ..... 272/136, 141, 143, 130, 272/137, 93, 78, 135, 142, 900; 403/348, 349

[56] References Cited

U.S. PATENT DOCUMENTS

| | | | |
|---|---|---|---|
| 2,820,655 | 1/1958 | Hileman | 403/349 |
| 2,959,414 | 11/1960 | Saltz | 272/136 |
| 4,026,548 | 5/1977 | Birdwell | 272/136 |
| 4,317,566 | 3/1982 | Uyeda et al. | 272/143 X |
| 4,384,715 | 5/1983 | Savio et al. | 272/136 |
| 4,428,578 | 1/1984 | Kirkpatrick | 272/136 |
| 4,518,162 | 5/1985 | Oates | 272/93 |

*Primary Examiner*—Richard J. Apley
*Assistant Examiner*—Robert W. Bahr
*Attorney, Agent, or Firm*—Jack C. Munro

[57] ABSTRACT

A door mounted exercising device which is to connect with the bottom edge of a door with the door being located in a closed position with respect to the door jamb. The exercising force is to be transmitted through the door against the door jamb. The exercising device is attached to the door by means of attaching bracket assembly which is removably secured to the door. The exercising device includes a tube within which is located a coil spring. The tube is removably connected through a pin and slot assembly to the attaching bracket assembly. The spring is mounted about a rod which is positioned within the tube. A portion of the rod extends exteriorly of the tube and is attached to a graspable handle assembly. The handle assembly is capable of being pivoted relative to the rod.

5 Claims, 4 Drawing Figures

DOOR MOUNTED EXERCISING DEVICE

BACKGROUND OF THE INVENTION

The field of this invention relates to an exercising device to be used within a home and more particularly to an exercising device which can be readily mounted on the lower edge of a closed door, thereby making the exercising device readily usable in any building structure.

The use of exercising devices has long been known. The present inventor previously designed a similar type of exercising device which is shown and described within U.S. Pat. No. 4,428,578, issued Jan. 31, 1984, entitled, "EXERCISING DEVICE".

Previous types of exercising devices have been complex in construction and are large in size. Also, such exercising equipment is frequently designed for one particular type of exercise and not readily usable with different types of exercises. Also, prior art type of exercising equipment is quite expensive and, therefore, not readily available to the masses.

SUMMARY OF THE INVENTION

The exercising device of this invention is designed to be employed in conjunction with a door which is located within a house or building. A bracket assembly is to be removably secured to the bottom edge of the door. The bracket assembly includes a slot assembly. A hollow tube has a protruding pin assembly at one end thereof. The protruding pin assembly is to connect with a slot assembly to permit a limited amount of pivoting movement of the tube relative to the bracket assembly. Within the tube there is located a compression spring. The compression spring is mounted about a rod. The rod is movable relative to the tube to compress the spring. A portion of the rod extends exteriorly of the tube and is attached to a graspable handle assembly. The handle assembly is capable of pivotal adjustment relative to the rod.

DETAILED DESCRIPTION OF THE SHOWN EMBODIMENT

Figure 1:
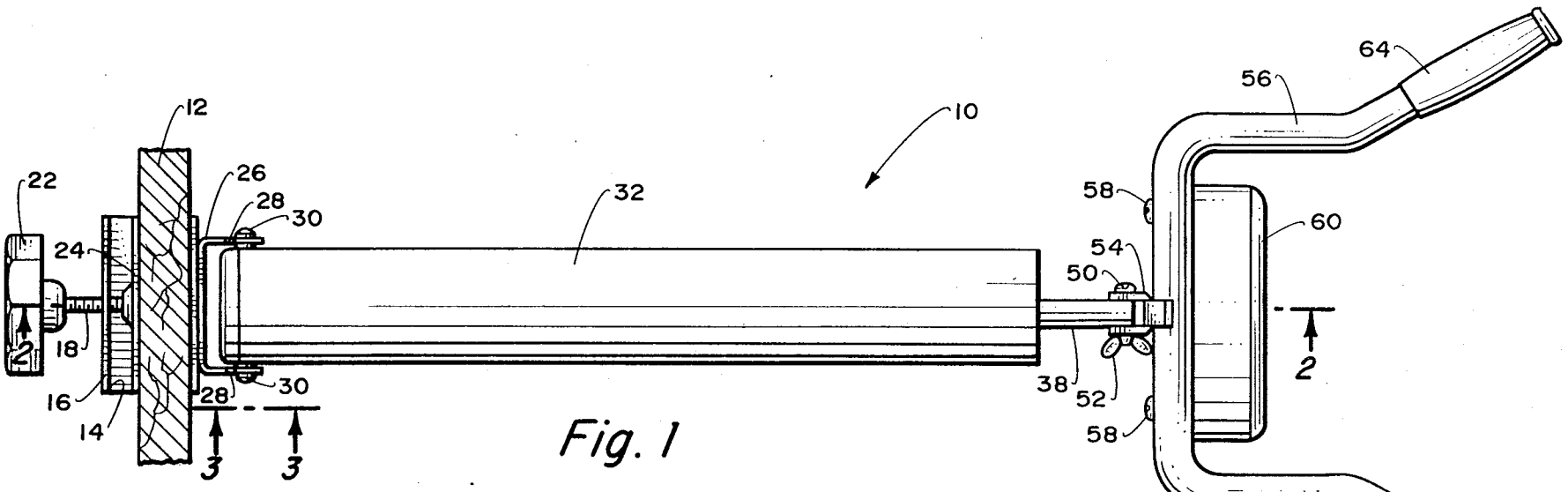
FIG. 1 is a top plan view of the exercising device of this invention showing the exercising device being attached to a conventional door.
Figure 2:
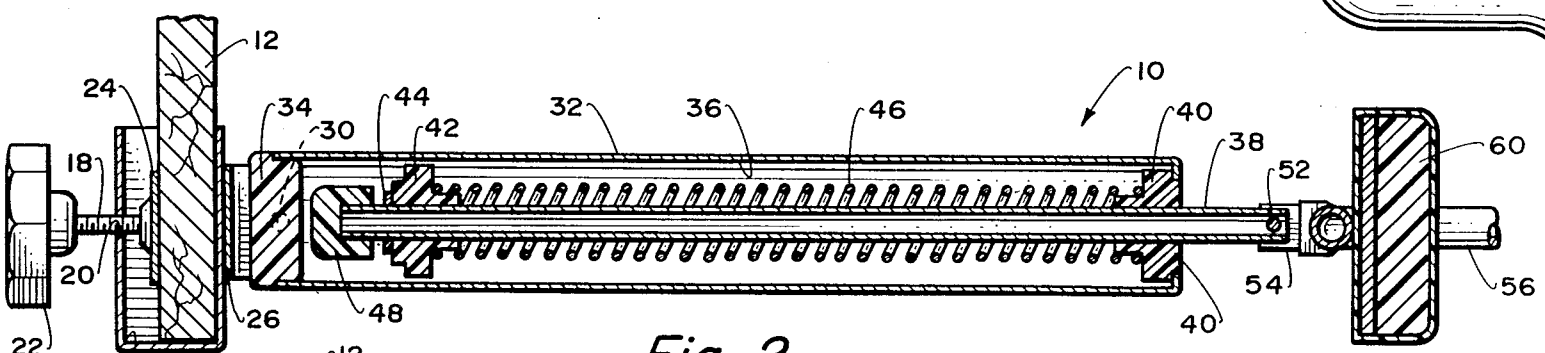
FIG. 2 is a cross-sectional view through the exercising device of this invention taken along line 2—2 of FIG. 1.
Figure 4:
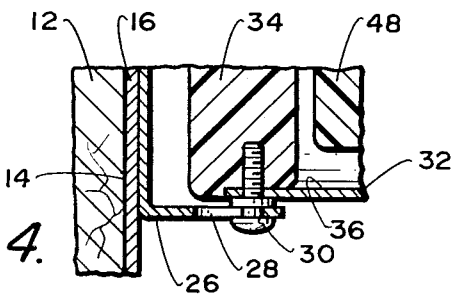
FIG. 4 is a cross-sectional view through a portion of the attaching bracket assembly taken along line 4—4 of FIG. 3.
Figure 3:
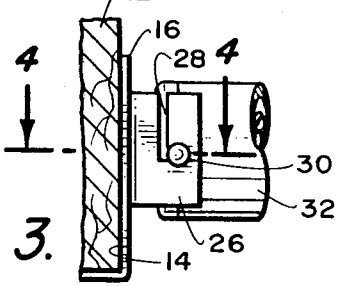
FIG. 3 is a side view of a portion of the exercising device of this invention taken along line 3—3 of FIG. 1 showing the connection between the tube and the attaching backet assembly.

Referring particularly to the drawing, there is shown the exercising device 10 of this invention which is to be mounted onto the lower edge of the conventional door 12. The lower edge of the door 12 fits within recess 14 of U-shaped member 16. A threaded rod 18 passes through a threaded hole 20 formed within the outer leg of the U-shaped member 16. The outer end of the threaded rod 18 is fixedly secured to a knob 22. The inner end of the threaded rod 18 is fixedly mounted onto plate 24. Plate 24 is to abut against the door 12. Manual rotation of the knob 22 in a clockwise direction will result in the plate 24 being pressed against the door 12 which binds the door 12 between the inner leg of the U-shaped bracket 16 and the plate 24. Movement of the knob 22 in a counterclockwise direction will result in spacing of the plate 24 from the door 12 to permit the U-shaped member 16 to be disengaged from the door 12.

Fixedly attached, as by welding, to the exterior surface of the inner leg of the U-shaped bracket 16 is a bifurcated member 26. Bifurcated member 26 defines a pair of legs, each of which includes an L-shaped slot 28. A pin 30 is to connect with each slot 28. The pins 30 are mounted on diametrically opposite positions on a tube 32. The inner end of the tube 32 is closed by means of a plug 34. The threaded ends of the pins 30 are tightly secured within the plug 34. Directly adjacent the enlarged head of each pin 30 is a groove which is to engage with its respective slot 28. Normally, the tube 32 will be constructed of a metallic material with the plug 34 being constructed of a plastic type of material.

Within the internal chamber 36 of the tube 32 there is located a rod 38. The rod 38 extends through a plastic sleeve 40 which is mounted within the outer open end of the tube 36 closing such to the ambient. A similar sleeve 42 is similarly mounted about the rod 38 and is located in a facing relationship to the sleeve 40 with the sleeve 42 being located directly adjacent the inner end of the rod 38. The position of the sleeve 42 is maintained by abutting against washer 44 which is fixedly secured onto the rod 38.

Extending between the sleeves 40 and 42 is a coil spring 46. The inner end of the rod 38 has mounted thereon a shock absorbing cap 48. Cap 48 will normally be constructed of a rubber material. The cap 48 is to physically contact the plug 34 to function as a stop for the inward movement of the rod 38.

The outer end of the rod 38 extends exteriorly of the tube 32 and is connected by a bolt 50 and wing nut 52 to a U-shaped bracket 54. The U-shaped bracket 54 is fixedly secured onto U-shaped handle member 56. The bolt 50 and the wing nut 52 facilitate pivotable movement of the handle member 56 relative to the rod 38. Once the desired orientation of the handle member 56 relative to the rod 38 has been obtained, the wing nut 52 is tightened onto bolt 50 thereby fixing in position the handle 56 relative to the rod 38.

The handle member 56 has an apex section on which there is mounted by bolts 58 a cushioning pad 60. When a user grasps handle grip sections 62 and 64 of the handle member 56 and pulls such toward the user, the cushioning pad 60 is to protect the user from direct contact with the apex section of the handle member 56. Also, the cushioning pad 60 can be used in performing of certain excercises as a head rest.

Pulling of the handle member 56 toward the user results in the compression spring 46 being compressed. It is the working against the force of the spring 56 by the user which results in the exercising motion.

For certain individuals, it may be desirable to have a stronger spring 46 or possibly even a weaker type of spring 46. In order to change springs 46, the user only need to remove the pins 30 from the plug 34 which will permit the plug 34 to be disengaged from the tube 32. The user then removes bolt 50 from the rod 38 which disengages the handle assembly 56 from the rod 38. The rod 38 then can be moved from the internal chamber 36 through the open end of the tube 32 which was normally closed by the plug 34. The spring 46 can then be interchanged and the device then reassembled.

What is claimed is:

1. In combination with a door, said door having a bottom edge to be located directly adjacent a floor, an exercising device to be connected to said door comprising:

an attaching bracket assembly to be fixedly mounted on said door, said attaching bracket assembly having a pair of L-shaped slots, said L-shaped slots being spaced apart;

a tube having a pair of pins attached thereto in a protruding manner, said pins to removably connect with said L-shaped slots, with said pins engaged with said L-shaped slots said tube being capable of a limited amount of pivoting movement relative to said attaching bracket assembly, said tube having an internal chamber;

a rod, said rod having an inner end located within said internal chamber and an outer end located exteriorly of said tube, said rod being movable relative to said tube;

a spring mounted about said rod and located within said internal chamber, said spring exerting a continuous bias tending to locate said rod almost totally confined within said internal chamber, movement of said rod to further space said outer end from said tube causes compressing of said spring; and a graspable handle attached by mounting means to said outer end of said tube, said graspable handle assembly to facilitate manual grasping by the user and movement of said rod relative to said tube.

2. The combination as defined in claim 1 wherein:

said graspable handle assembly being pivotally mounted to said tube.

3. The combination as defined in claim 2 wherein:

said mounting means including a position fixing means for fixing said graspable handle assembly to said rod, upon the desired pivotal connection being established between said graspable handle assembly and said rod said position fixing means being tightenable to fix the now established position of said graspable handle assembly relative to said rod.

4. The combination as defined in claim 1 wherein:

a plug being mounted within said internal chamber closing such to the ambient, said pins being mounted on said plug.

5. The combination as defined in claim 4 wherein:

a shock absorbing member mounted on said inner end of said rod, said plug further functioning as a stop to limit the movement of said rod when such is almost totally confined within said internal chamber, said shock absorbing member to connect with said plug.

* * * * *